US009568927B2

(12) United States Patent
Youssef et al.

(10) Patent No.: US 9,568,927 B2
(45) Date of Patent: Feb. 14, 2017

(54) CURRENT MODULATION CIRCUIT

(71) Applicants: STMicroelectronics, Inc., Coppell, TX (US); STMicroelectronics S.r.l., Agrate Brianza (IT)

(72) Inventors: Tom Youssef, Frisco, TX (US); Alessandro Gasparini, Cusano Milanino (IT); Yamu Hu, Allen, TX (US); Naren K. Sahoo, Frisco, TX (US); Anthony Junior Casillan, Irving, TX (US)

(73) Assignees: STMICROELECTRONICS, INC., Coppell, TX (US); STMICROELECTRONICS S.R.L., Agrate Brianza (IT)

( * ) Notice: Subject to any disclaimer, the term of this patent is extended or adjusted under 35 U.S.C. 154(b) by 376 days.

(21) Appl. No.: 14/270,677

(22) Filed: May 6, 2014

(65) Prior Publication Data

US 2015/0323944 A1 Nov. 12, 2015

(51) Int. Cl.

| | |
|---|---|
| ***G05F 1/00*** | (2006.01) |
| ***G05F 1/56*** | (2006.01) |
| ***G05F 1/10*** | (2006.01) |

(52) U.S. Cl.

CPC ..... *G05F 1/561* (2013.01); *G05F 1/10* (2013.01)

(58) Field of Classification Search

CPC ..... G05F 1/56; G05F 1/575; G05F 1/465; G05F 1/468; G05F 1/462; G05F 1/562

USPC ..... 323/273–275, 282–285

See application file for complete search history.

(56) References Cited

U.S. PATENT DOCUMENTS

2010/0164403 A1* 7/2010 Liu ..... H05B 33/086 315/297

2011/0074839 A1* 3/2011 Liu ..... G09G 3/342 345/690

FOREIGN PATENT DOCUMENTS

CN 204790659 U 11/2015

OTHER PUBLICATIONS

Second Office Action and Search Report from co-pending CN Appl. No. 201510224931.4 dated Nov. 23, 2016 (5 pages).

* cited by examiner

*Primary Examiner* — Adolf Berhane
*Assistant Examiner* — Afework Demisse
(74) *Attorney, Agent, or Firm* — Gardere Wynne Sewell, LLP

(57) ABSTRACT

A modulated digital input signal is passed through a conditioning circuit to generate a first input signal. An error amplifier circuit receives the first input signal and a second input signal, and controls the operation of a MOS transistor to generate an output signal that is current modulated. The output signal is sensed to generate a feedback signal. A switching circuit selectively applies the feedback signal as the second input signal in response to a transition of the modulated digital input signal from a first logic state to a second logic state. The switching circuit alternatively selectively applies a fixed reference signal as the second input signal to the error amplifier in response to a transition of the modulated digital input signal from the second logic state to the first logic state.

26 Claims, 9 Drawing Sheets

CURRENT MODULATION CIRCUIT

TECHNICAL FIELD

The present disclosure generally relates to a current modulation circuit.

BACKGROUND

Current modulation circuits are used in a number of applications. The Peripheral Sensor Interface (PSTS) is an interface used, for example, in automotive sensor applications wherein an electronic control unit (ECU) and sensor are coupled by a two-wire interface supporting both power supply and data transmission. The ECU provides a regulated voltage to the sensor, and the sensor transmits data to the ECU on the supply line using current modulation. The current modulation is detected by the ECU and decoded to recover the original digital data stream generated at the sensor.

Specifications governing configuration and operation of the interface must be followed by the current modulator in the sensor when transmitting data to the ECU. There is a need in the art for a current modulator circuit that operates in accordance with specifications and without introducing distortion.

SUMMARY

In an embodiment, a circuit comprises: a controlled current source configured to generate an output current in response to a difference between a first input signal derived from a modulated digital input signal and a second input signal; a current sensing circuit configured to sense the output current and generate a feedback signal; a switching circuit configured to selectively apply one of a fixed reference signal and the feedback signal as the second input signal to the controlled current source; wherein the switching circuit is configured to apply the feedback signal as the second input signal in response to a transition of the modulated digital input signal from a first logic state to a second logic state; and wherein the switching circuit is configured to apply the fixed reference signal as the second input signal in response to a transition of the modulated digital input signal from the second logic state to the first logic state.

In an embodiment, a method comprises: generating an output current in response to a difference between a first input signal derived from a modulated digital input signal and a second input signal; sensing the output current to generate a feedback signal; and selectively applying a fixed reference signal or the feedback signal as the second input signal. Selectively applying comprises: applying the feedback signal in response to a transition of the modulated digital input signal from a first logic state to a second logic state; and applying the fixed reference signal in response to a transition of the modulated digital input signal from the second logic state to the first logic state.

In an embodiment, a circuit comprises: an input configured to receive a modulated digital input signal; a conditioning circuit having an input configured to receive the modulated digital input signal and an output configured to generate a first input signal having sloped logic state transitions; an error amplifier circuit having a first input configured to receive the first input signal and a second input configured to receive a second input signal; a MOS transistor having a gate coupled to an output of the error amplifier and a source-drain path configured to generate an output signal that is current modulated in accordance with the modulated digital input signal; a sensing circuit configured to sense said output signal and generated a feedback signal; a switching circuit configured to selectively apply one of a fixed reference signal and the feedback signal as the second input signal to the error amplifier; and a control circuit configured to control operation of the switching circuit so as to: apply the feedback signal as the second input signal in response to a transition of the modulated digital input signal from a first logic state to a second logic state; and apply the fixed reference signal as the second input signal in response to a transition of the modulated digital input signal from the second logic state to the first logic state.

The foregoing and other features and advantages of the present disclosure will become further apparent from the following detailed description of the embodiments, read in conjunction with the accompanying drawings. The detailed description and drawings are merely illustrative of the disclosure, rather than limiting the scope of the invention as defined by the appended claims and equivalents thereof

BRIEF DESCRIPTION OF DRAWINGS

Embodiments are illustrated by way of example in the accompanying figures not necessarily drawn to scale, in which like numbers indicate similar parts, and in which:

FIG. 2 illustrates operating waveforms for the current modulator circuit of

FIG. 1;

DETAILED DESCRIPTION OF THE DRAWINGS

Figure 1:
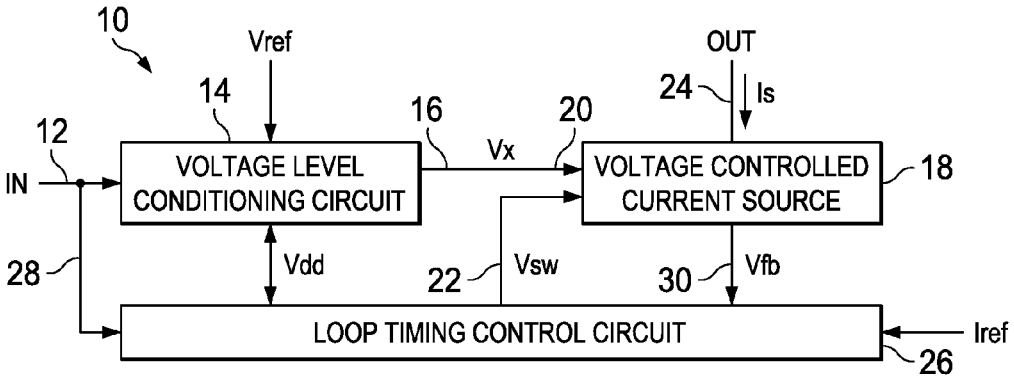
FIG. 1 is a block diagram of a current modulator circuit.

Reference is now made to FIG. 1 which illustrates a block diagram of a current modulator circuit 10. The circuit 10 includes an input node 12 configured to receive an input data signal (IN). The input data signal may comprise an encoded data stream. In an embodiment, the encoded data stream may comprise Manchester encoded data.

The circuit 10 further includes a voltage level conditioning circuit 14 which receives the input data signal from the input node 12. The voltage level conditioning circuit 14 generates a reference voltage signal Vx at an output node 16. The voltage level of the reference voltage signal Vx varies over time in a manner which generally corresponds to the changing logic state of the input data signal. The reference voltage signal Vx has a maximum voltage level equal to a fixed reference voltage Vref.

The circuit 10 also includes voltage controlled current source circuit 18. The voltage controlled current source circuit 18 includes an input node 20 coupled to receive the reference voltage signal Vx from the voltage level conditioning circuit 14 output node 16. The voltage controlled current source circuit 18 also includes an input node 22 coupled to receive a switched voltage Vsw. Responsive to a comparison of the reference voltage signal Vx to the switched voltage Vsw, the voltage controlled current source circuit 18 generates an output current Is at an output node 24. The voltage controlled current source circuit 18 further operates to sense the output current Is and generate a feedback voltage signal Vfb which is indicative of the sensed output current.

The circuit further includes a loop timing control circuit 26. The loop timing control circuit 26 includes an input node 28 configured to receive the input data signal (IN) and an input node 30 configured to receive the feedback voltage signal Vfb. The loop timing control circuit 26 responds to the logic state of the input data signal (IN) to selectively switch (i.e., connect) either the feedback voltage signal Vfb as the switched voltage Vsw or an internal reference voltage Vdd as the switched voltage Vsw. For example, in response to a first logic state (such as logic "1") of the input data signal (IN), the loop timing control circuit 26 connects the feedback voltage signal Vfb as the switched voltage Vsw to the input node 22 of the voltage controlled current source circuit 18. Conversely, in response to a second logic state (such as logic "0") of the input data signal (IN), the loop timing control circuit 26 connects the internal reference voltage Vdd for application as the switched voltage Vsw to the input node 22 of the voltage controlled current source circuit 18. The precise timing of the connections is controlled by the loop timing control circuit 26 in a manner described in detail herein.

Figure 2:
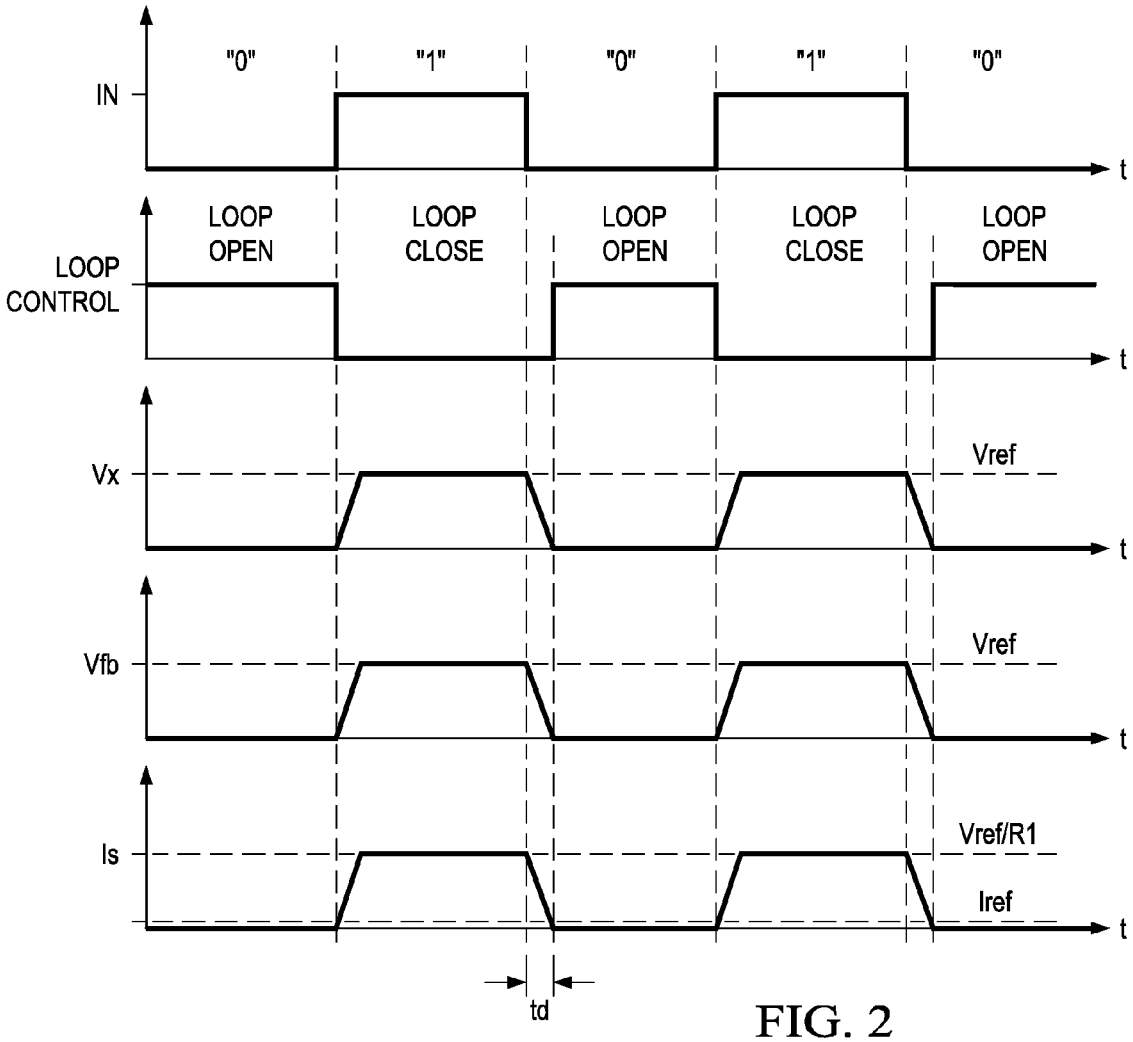

Reference is now additionally made to FIG. 2 which illustrates operating waveforms for the current modulator circuit 10 of FIG. 1. The loop timing control circuit 26 responds to the input data signal (IN) by changing the state of a switched loop. The switched loop is closed responsive to a logic high "1" state of the input data signal (IN), and in this state the feedback loop applies the feedback voltage signal Vfb as the switched voltage Vsw to the input node 22 of the voltage controlled current source circuit 18. Conversely, the switched loop is opened responsive to a logic low "0" state of the input data signal (IN), and in this state the feedback loop applies the internal reference voltage Vdd as the switched voltage Vsw to the input node 22 of the voltage controlled current source circuit 18.

When the input data signal (IN) transitions from low to high, the reference voltage signal Vx starts to ramp up slowly until it reaches the maximum voltage level set by the fixed reference voltage Vref. The switched loop is closed and the signals Vx and Vfb that are applied to the inputs of the voltage controlled current source circuit 18 cause the output current Is to rise at a rate that is almost the same as Vx. The rise in output current Is continues until Vfb=Vx. When the input data signal (IN) subsequently transitions from high to low, the reference voltage signal Vx starts to ramp down slowly and the output current Is correspondingly begins to fall. Although the input data signal (IN) is low, the switched loop does not immediately change state. The output current is sensed (through the signal Vfb) and compared to a reference current Iref by the loop timing control circuit 26. When the sensed current falls below Iref, the switched loop state changes to open. At this point, the internal reference voltage Vdd is instead applied in the feedback loop as the switched voltage Vsw. This internal reference voltage Vdd exceeds the reference voltage signal Vx and causes the current generator of the voltage controlled current source circuit 18 to turn off The current sense and comparison operation introduces a delay td between the time when the input data signal (IN) transitions from high to low and the time when the switched loop opens.

Figure 3:
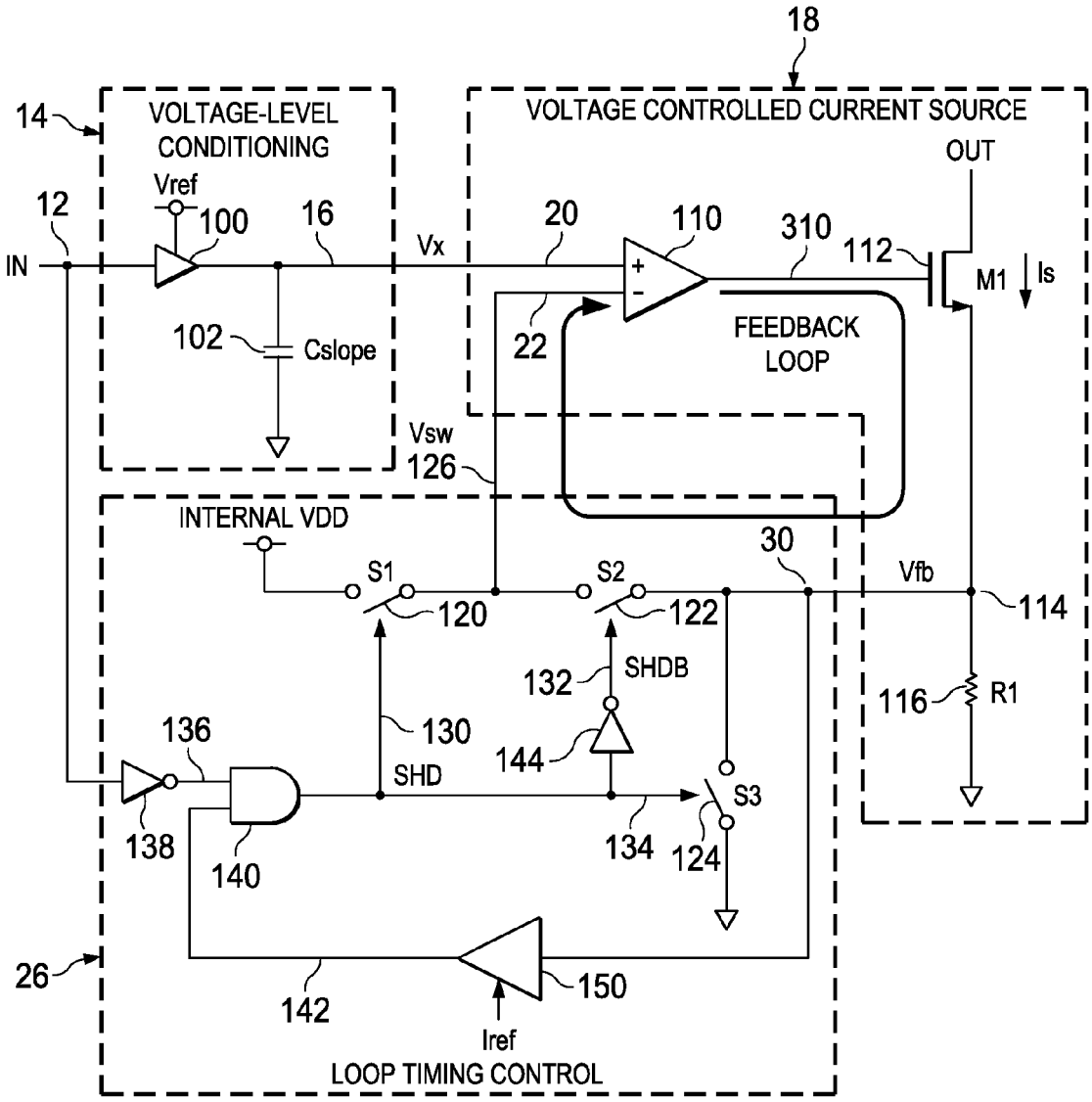
FIG. 3 is a circuit diagram for the current modulator circuit of FIG. 1.

Reference is now made to FIG. 3 which illustrates an exemplary circuit diagram for the current modulator circuit 10 of FIG. 1.

The voltage level conditioning circuit 14 includes a switched current source circuit 100 and a slope capacitor (Cslope) 102. The switched current source circuit 100 operates responsive to the input data signal (IN) (at input 12) to charge and discharge the slope capacitor 102. The switched current source circuit 100 may be configured (see, FIG. 4) as two opposed current sources coupled to the first plate of the slope capacitor 102 at the output node 16 with actuation of the opposed current sources controlled by the logic state of the input data signal (IN).

The voltage controlled current source circuit 18 includes an error amplifier 110 having a non-inverting input (+) configured to receive the reference voltage signal Vx from input 20 and an inverting input (−) configured to receive the switched voltage Vsw from input 22. A MOS transistor (M1) 112 has a gate terminal coupled to the output 310 of the error amplifier 110. The drain terminal of transistor 112 is coupled to an output node 24. The source terminal of transistor 112 is coupled at node 114 in series with a sense resistor (R1) 116 coupled to a reference voltage node (ground). The feedback voltage signal Vfb is generated across resistor 116 in response to the flow of the output current Is in the source-drain path of transistor 112.

The loop timing control circuit 26 includes switching circuitry comprising a first switch (S1) 120, a second switch (S2) 122 and a third switch (S3) 124. The first switch 120 is coupled between the internal reference voltage Vdd and an output node 126 where the switched voltage Vsw is provided to node 22. The second switch 122 is coupled between input node 30 (receiving the feedback voltage signal Vfb) and the output node 126. The third switch 124 is coupled between input node 30 (receiving the feedback voltage signal Vfb) and the reference voltage node (ground). The switches 120, 122 and 124 are actuated by corresponding first, second and third control signals 130, 132 and 134, respectively, generated by logic circuitry 136.

The logic circuitry 136 includes an inverter 138 having an input coupled to receive the input data signal (IN) from node 12. An output of the inverter 138 is coupled to a first input of a logic-AND gate 140. A second input of the logic-AND gate 140 receives a delay control signal 142. The output (signal SHD) of the logic-AND gate 140 provides the first and third control signals 130 and 134. An inverter 144 has an input coupled to the output SHD of the logic-AND gate to generate the second control signal 132 (SHDB).

A comparator circuit 150 has an input coupled to the input node 30 (receiving the feedback voltage signal Vfb). As the feedback voltage signal Vfb is developed across resistor 116 in response to the output current Is, the voltage Vfb corresponds to the current Is. The comparator 150 further receives the reference current Iref and thus functions as a current comparator to perform a comparison of Is to Iref. The delay control signal 142 is generated at the output of comparator circuit 150. When Is exceeds Iref, the delay control signal 142 has a first logic state (for example, logic "0"), and when Iref exceeds Is, the delay control signal 142 has a second logic state (for example, logic "1"). When the delay control signal 142 is in the first logic state (logic "0"), the logic-AND gate 140 blocks a change in the logic state of output SHD when the inverted input data signal (IN) changes state. This controls the implementation of the time delay td (FIG. 2).

Figure 4:
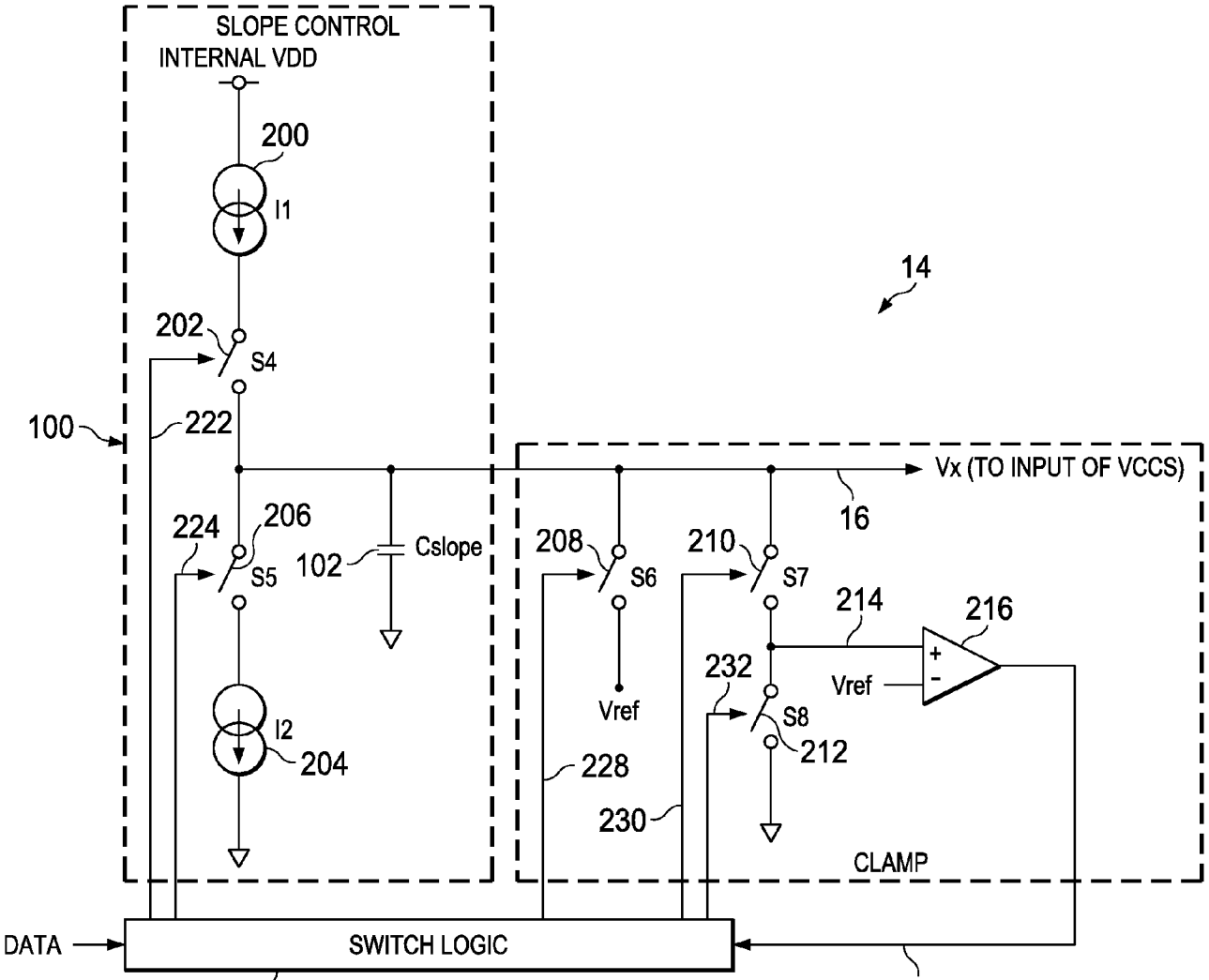
FIG. 4 is a circuit diagram for a voltage level conditioning circuit.

Reference is now made to FIG. 4 which is a schematic diagram of the voltage level conditioning circuit 14 including the switched current source circuit 100 and the slope capacitor (Cslope) 102. The switched current source circuit 100 includes a sourcing circuit 200 (generating current II) and fourth switch (S4) 202 coupled in series between the internal reference voltage Vdd and node 16. The switched current source circuit 100 further includes a sinking circuit 204 (generating current 12) and fifth switch (S5) 206 coupled in series between the node 16 and the reference voltage node (ground). A sixth switch (S6) 208 is coupled between the node 16 and the fixed reference voltage Vref. A seventh switch (S7) 210 and eighth switch (S8) 212 are coupled in series at node 214 between the node 16 and reference voltage node (ground). A comparator circuit 216 has a non-inverting input (+) coupled to the node 214 and an inverting (−) input coupled to the fixed reference voltage Vref. The comparator circuit 216 generates a clamp signal 220.

The switches 202, 206, 208, 210 and 212 are actuated by corresponding fourth, fifth, sixth, seventh and eighth control signals 222, 226, 228, 230 and 232, respectively, generated by logic circuitry 218. The logic circuitry 218 receives the input data signal (IN) from node 12 and a clamp signal 220 output from the comparator circuit 216. Those skilled in the art understand how to design the logic circuitry 218 to implement the required functions and generate the appropriate control signals in response to the logic states of the input data signal (IN) and the clamp signal 220.

Figure 5:
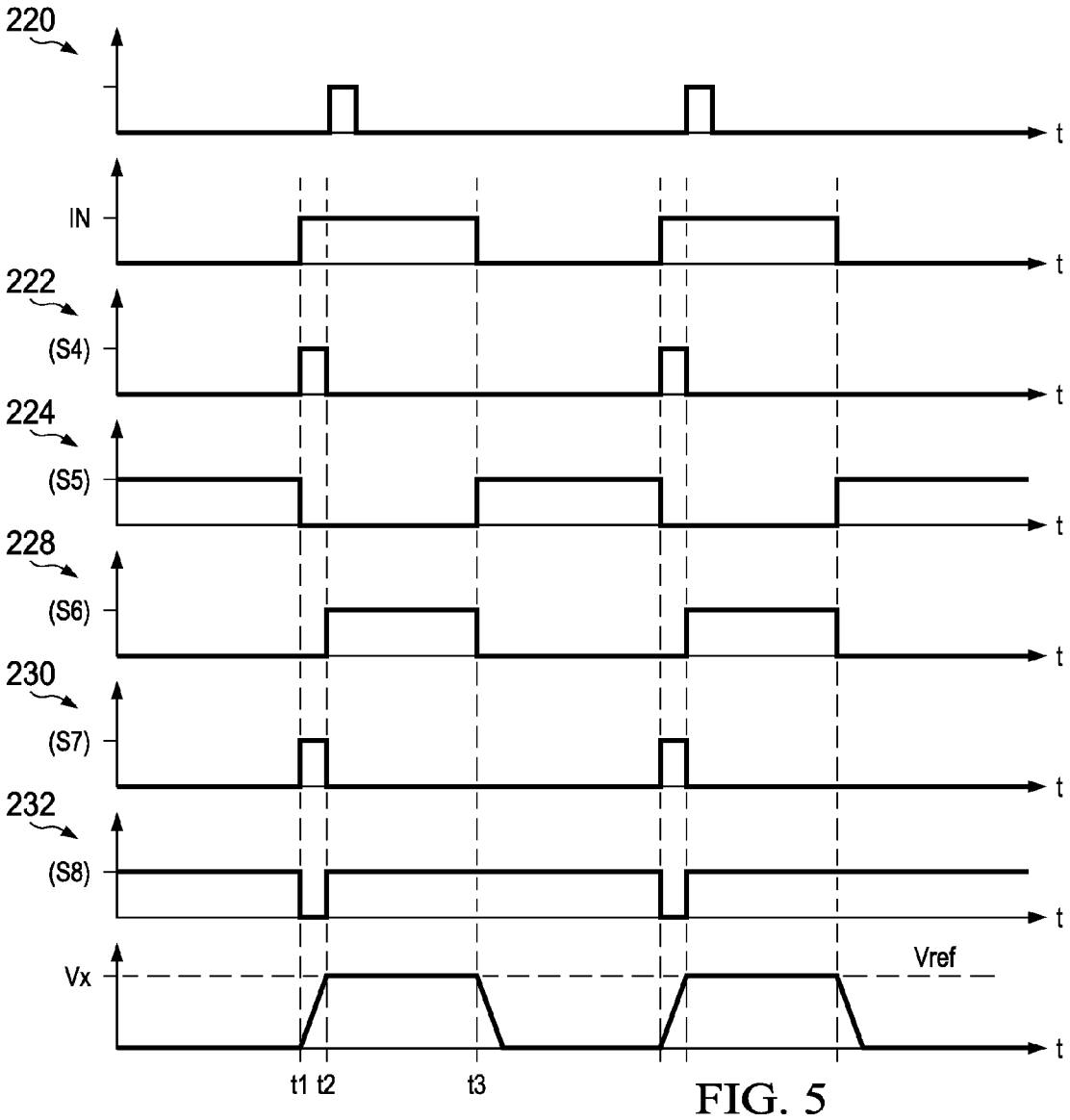
FIG. 5 illustrates operating waveforms for the voltage level conditioning circuit of FIG. 4.

Reference is now additionally made to FIG. 5 which illustrates operating waveforms for the voltage level conditioning circuit 14 of FIG. 4. The voltage level conditioning circuit 14 provides the reference voltage signal Vx for the current modulation operation in response to the input data signal (IN). The circuit 14 controls signal rise time and fall time as well as limiting the voltage used to generate the output current Is. In this way, the circuit 14 can control output current Is generation to meet specification parameters (such as the specification parameters in accordance with the PSIS specification). When the input data signal (IN) is logic low ("0"), the logic circuitry 218 generates logic states for the fourth, fifth, sixth, seventh and eighth control signals 222, 226, 228, 230 and 232 such that switches S5 and S8 are closed (on) and switches S4, S6 and S7 are open (off). In this condition, the capacitor Cslope is fully discharged by the operation of current 12 and the non-inverting input (+) of comparator 216 is grounded. The reference voltage signal Vx is at 0V and the clamp signal 220 is logic low ("0"). When the input data signal (IN) transitions from logic low to logic high ("1") at time t1, the logic circuitry 218 generates logic states for the fourth, fifth, sixth, seventh and eighth control signals 222, 226, 228, 230 and 232 such that switches S4 and S7 are closed (on) and switches S5 and S8 are open (off), with switch S6 remaining open (off). In this condition, the capacitor Cslope begins to charge in response to the current I1 and the reference voltage signal Vx increases. The reference voltage signal Vx is now applied to the non-inverting input (+) of comparator 216 for comparison against the fixed reference voltage Vref. At the point when reference voltage signal Vx exceeds the fixed reference voltage Vref (time t2), the clamp signal 220 changes state to logic high ("1"). The logic circuitry 218 responds to this change of state of the clamp signal 220 by generating logic states for the fourth, fifth, sixth, seventh and eighth control signals 222, 226, 228, 230 and 232 such that switches S4 and S7 are open (off) and switches S6 and S8 are closed (on), with switch S5 remaining open (off). In this condition, no further charging of the capacitor Cslope occurs and the reference voltage signal Vx is clamped to the fixed reference voltage Vref by switch S6. The turning on of switch S8 applies the ground reference to non-inverting input of comparator 216 and the clamp signal 220 switches back to logic low. When the input data signal (IN) transitions from logic high back to logic low at time t3, the logic circuitry 218 generates logic states for the fourth, fifth, sixth, seventh and eighth control signals 222, 226, 228, 230 and 232 such that switches S5 and S8 are closed (on) and switches S4, S6 and S7 are open (off). In this condition, the capacitor Cslope is discharged by the current I1 and the reference voltage signal Vx decreases until reaching 0V. The process then repeats with the next logic state transition of the input data signal (IN).

Figure 6C:
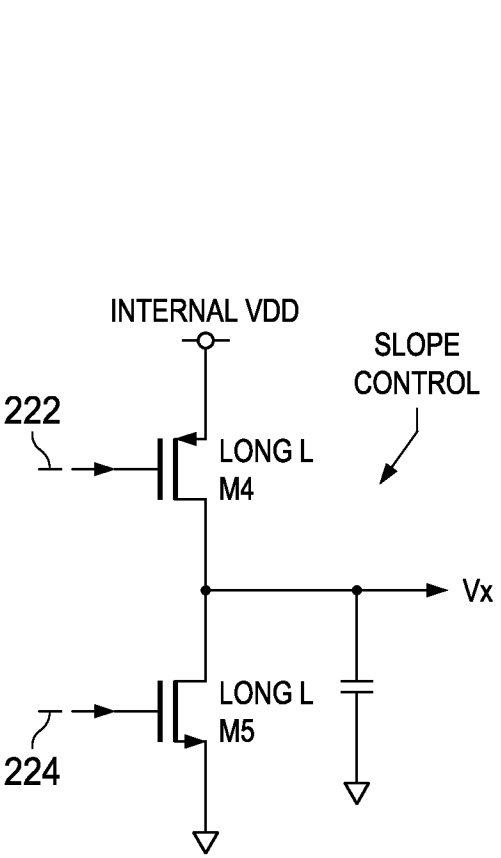
FIGS. 6A-6C show circuit configurations for a switched current source circuit.
Figure 6B:
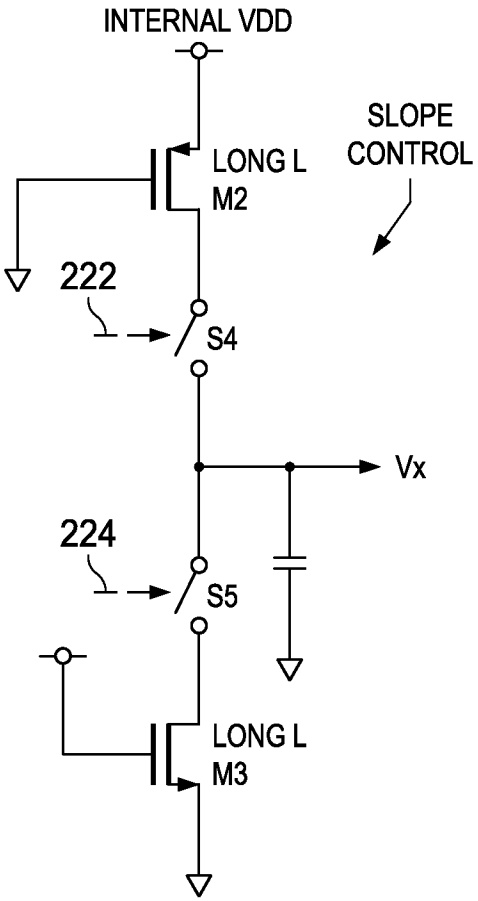
Figure 6A:
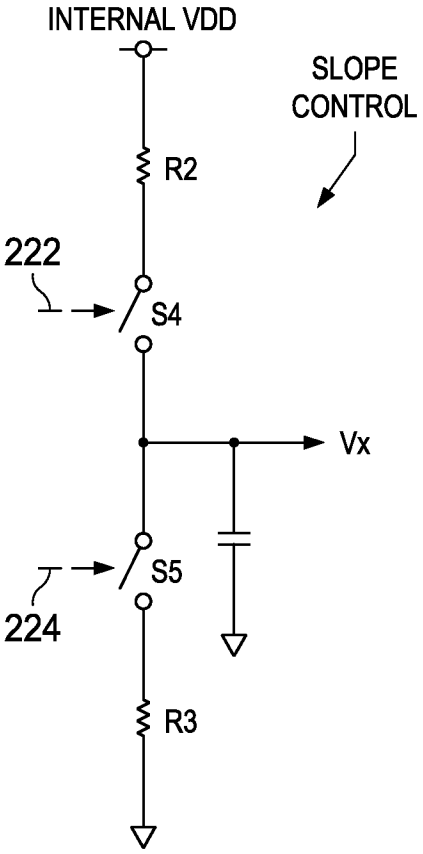

The switched current source circuit 100 can have alternate circuit configurations than what is shown in FIG. 4. FIGS. 6A-6C show three different circuit configurations for the switched current source circuit 100. In FIG. 6A, the sourcing circuit 200 and sinking circuit 204 are replaced with resistors R2 and R3. In FIG. 6B, the sourcing circuit 200 and sinking circuit 204 are replaced with transistors M2 (PMOS with gate tied to ground) and M3 (NMOS with gate tied to Vdd), wherein the transistors M2 and M3 are fabricated with long lengths (L). In FIG. 6C, the sourcing circuit 200, fourth switch (S4) 202, sinking circuit 204 and fifth switch (S5) 206 are replaced with transistors M4 (PMOS with gate receiving control signal 222) and M5 (NMOS with gate receiving control signal 224), wherein the transistors M4 and M5 are fabricated with relatively longer lengths (L) than other included MOS transistors.

Figure 7A:
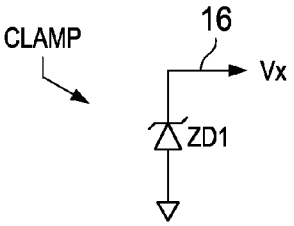
FIGS. 7A-7F show circuit configurations for clamping circuitry.
Figure 7B:
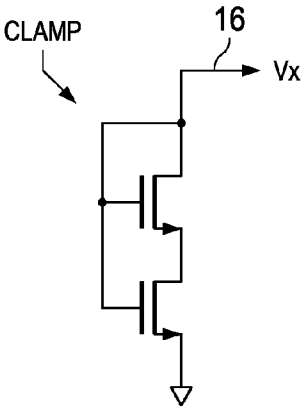
Figure 7C:
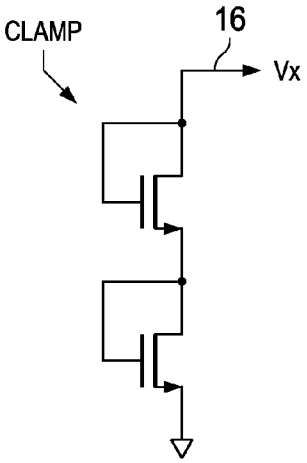
Figure 7D:
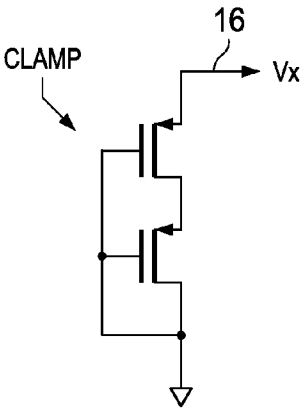
Figure 7E:
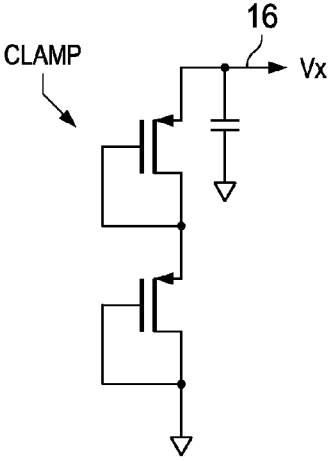
Figure 7F:
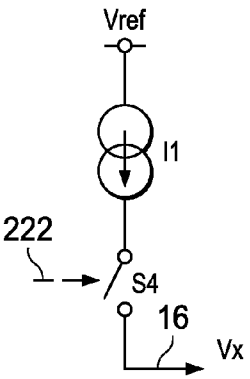

The circuitry for implementing the clamping of the reference voltage signal Vx to the fixed reference voltage Vref can have alternate circuit configurations than what is shown in FIG. 4. FIGS. 7A-7F show six different circuit configurations to replace the switch S6. In FIG. 7A, the clamped voltage is provided through a properly selected zener diode ZD1 coupled between node 16 and ground. In FIG. 7B, the clamped voltage is provided through the use of a plurality of series connected NMOS transistors whose gate terminals are tied to node 16. In FIG. 7C, the clamped voltage is provided through the use of a plurality of diode-connected NMOS transistors coupled in series. In FIG. 7D, the clamped voltage is provided through the use of a plurality of series connected PMOS transistors whose gate terminals are tied to ground. In FIG. 7E, the clamped voltage is provided through the use of a plurality of diode-connected PMOS transistors coupled in series. In FIG. 7F, the sourcing circuit 200 is coupled to the fixed reference voltage Vref instead of the internal reference Vdd.

Figure 8:
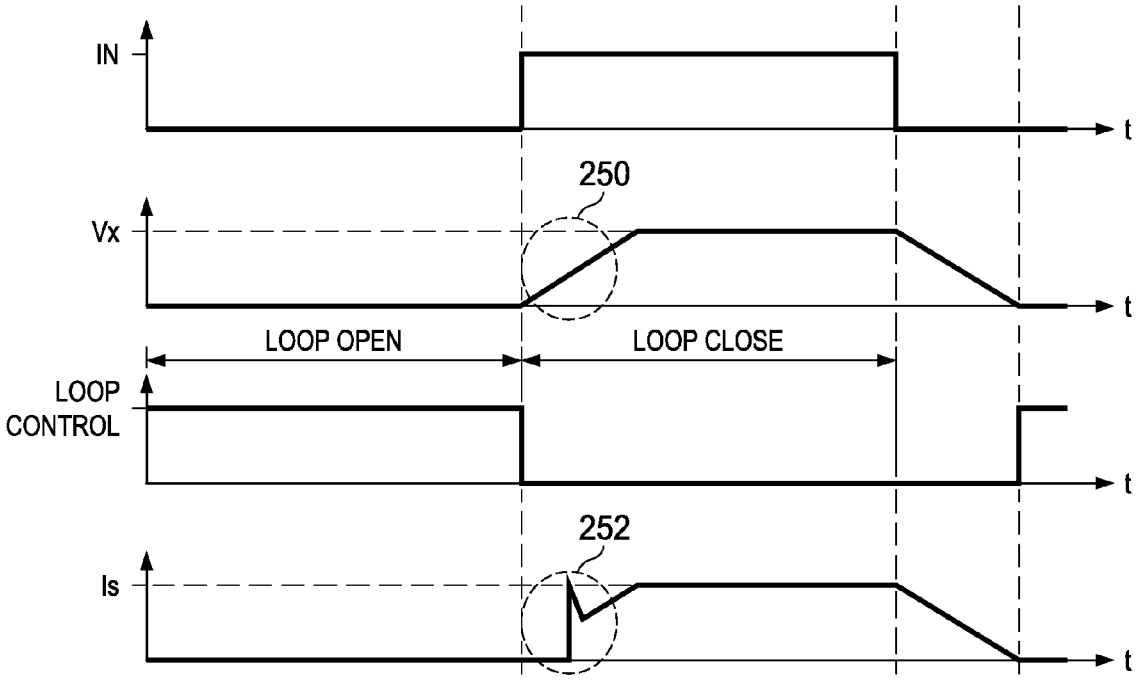
FIG. 8 illustrates operating waveforms for the current modulator circuit showing output distortion.

Reference is once again made to FIG. 3 along with FIG. 8. The error amplifier 110 has a relatively slow transient response in order to ensure stability in closed-loop system applications. However, this characteristic can pose an issue. The feedback loop of the error amplifier 110 opens and closes in accordance with the input data signal (IN) as controlled by the loop timing control circuit 26. When the input data signal (IN) is at logic low ("0"), the feedback loop is open and the error amplifier acts as a comparator (with the reference voltage Vdd applied to the inverting (−) input). When the input data signal (IN) transitions to logic high ("1"), the feedback loop is closed through actuation of switch S2 and at the same time the non-inverting (+) input receives the rising reference voltage signal Vx. Because the error amplifier 110 needs time to settle and drive transistor (M1) 112, the error amplifier is not able to immediately respond to the input signal Vx (reference 250). There is a temporary instability in the circuit operation while the reference voltage signal Vx rises and a distortion (in the form of a current spike: reference 252) is introduced in the output current Is.

Figure 9:
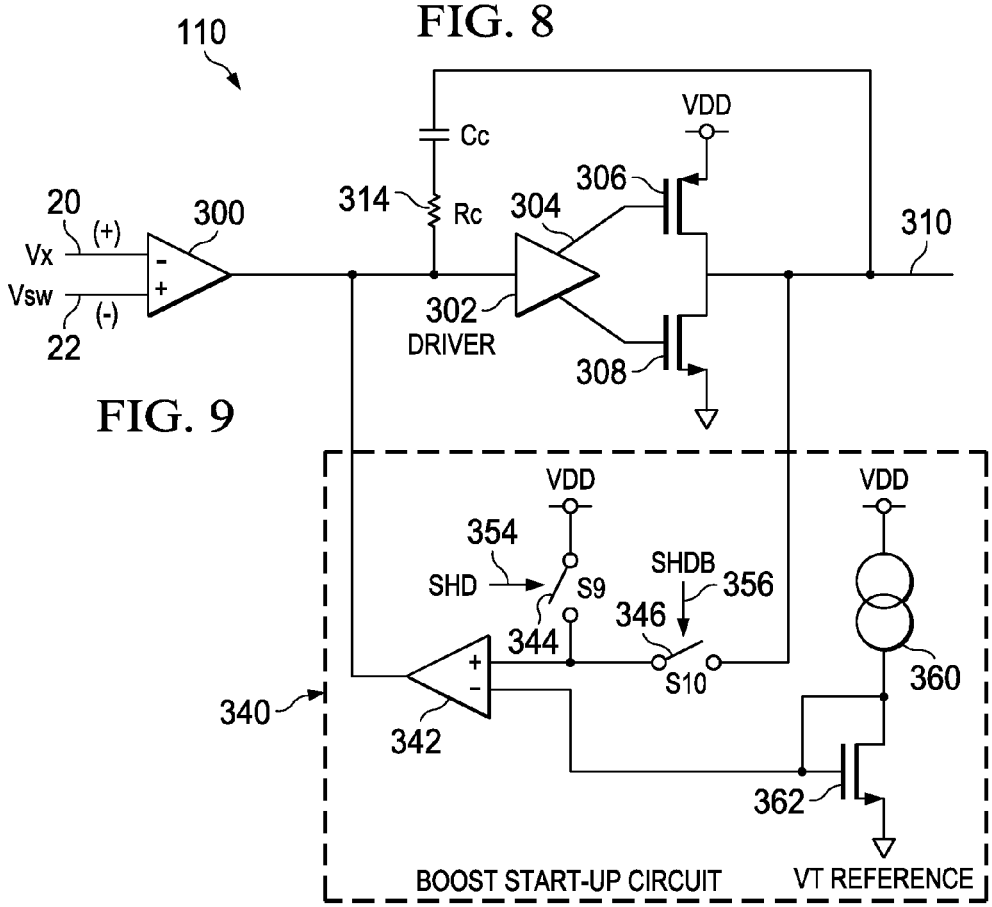
FIG. 9 is a circuit diagram of the error amplifier of FIG. 3.

Reference is now made to FIG. 9 which illustrates a circuit diagram for the error amplifier 110 of FIG. 3. The error amplifier 110 includes an input differential amplifier circuit 300 having an inverting input (−) coupled to the amplifier 110 non-inverting input (+) which receives the reference voltage signal Vx from input 20 and a non-inverting input (+) coupled to the amplifier 110 inverting input (−) which receives the switched voltage Vsw from input 22. The output of the input differential amplifier circuit 300 is coupled to the input of a differential driver circuit 302. The differential driver circuit 302 has a differential output coupled to a push-pull circuit 304 comprising a PMOS transistor 306 connected in series with an NMOS transistor 308 between the reference voltage Vdd and ground. A first (non-inverting) output from the differential driver circuit 302 is coupled to the gate of transistor 306, and a second (inverting) output from the differential driver circuit 302 is coupled to the gate of transistor 308. The drain nodes of transistors 306 and 308 are connected at an error amplifier output node 310. The error amplifier output node 310 is coupled to the input of the differential driver circuit 302 through a compensation circuit 314 formed of a compensation capacitor Cc coupled in series with a compensation resistor Rc.

To address the distortion issue discussed above, the error amplifier 110 further includes a boost start-up circuit 340 coupled between error amplifier output node 310 and the input of the differential driver circuit 302. The boost start-up circuit 340 includes a differential amplifier circuit 342 having an inverting input (−) and a non-inverting input (+), with an output of the differential amplifier circuit 342 coupled to the input of the differential driver circuit 302. A ninth switch (S9) 344 is coupled between the non-inverting input (+) and the reference voltage Vdd. A tenth switch (S10) 346 is coupled between the non-inverting input (+) and the error amplifier output node 310. The switches 344 and 346 are actuated by corresponding ninth and tenth control signals 354 and 356, respectively, generated by the loop timing control circuit 26. More specifically, the output (SHD) of the logic-AND gate 140 and its complement (SHDB) are applied as the control signals 354 and 356, respectively. The boost start-up circuit 340 further includes a current source 360 coupled in series with a diode-connected MOS transistor 362 between the reference voltage Vdd and ground. The gate of transistor 362 is coupled to the inverting input (−) of the differential amplifier circuit 342 which receives a reference voltage equal to the threshold voltage (VT) of the transistor 362.

The boost start-up circuit 340 assists the input differential amplifier circuit 300 to drive the error amplifier output node 310 in response to a transition of the input data signal (IN) to logic high ("1"). As discussed above, this transition causes the feedback loop to close through the actuation of switch S2 by the signal SHDB. The switch S10 is likewise actuated and the differential amplifier circuit 342 operates to compare the voltage at the error amplifier output node 310 to the threshold voltage (VT) of the transistor 362. The differential amplifier circuit 342 will drive the error amplifier output node 310 (through the differential driver circuit 302) for a short duration until the voltage at the error amplifier output node 310 equals the threshold voltage (VT) of the transistor 362, and the concern with the response time of the input differential amplifier circuit 300 and the distortion of output current Is are obviated. The transistor M1 will begin to conduct under the control of differential amplifier circuit 342. After the short duration expires, the input differential amplifier circuit 300 will have settled and the established feedback path through switch S2 and the input differential amplifier circuit 300 will take control over the driving of transistor M1.

Figure 10:
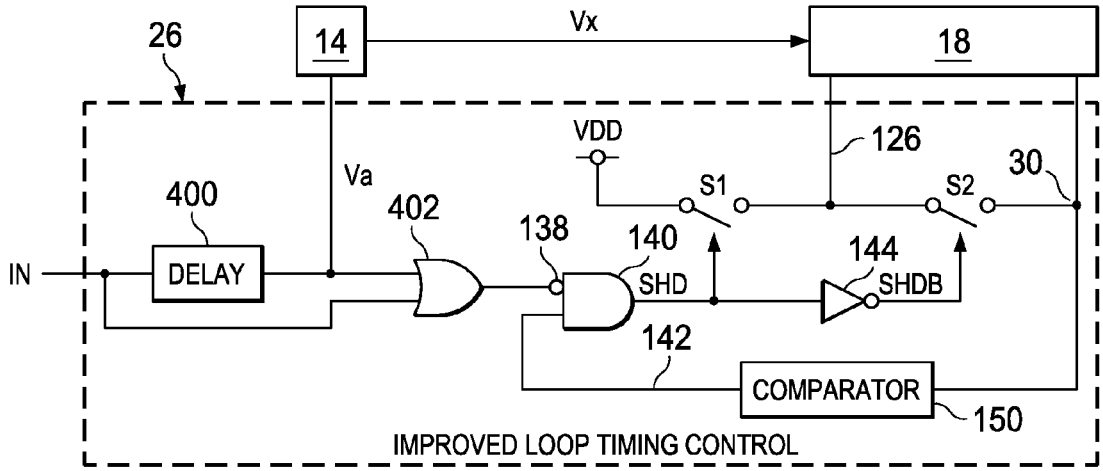
FIG. 10 is a circuit diagram for an alternate circuit configuration for the loop timing control circuit.

Reference is now made to FIG. 10 which illustrates a circuit diagram for an alternate circuit configuration for the loop timing control circuit 26. Like reference numbers refer to like or similar parts in FIG. 3, and will not be further described. The input data signal (IN) in received at a delay circuit 400. The output of the delay circuit 400 generates a signal Va which is applied to the input of the voltage level conditioning circuit 14. The signal Va and the input data signal (IN) are applied to the inputs of a logic-OR gate 402. The output of the logic-OR gate 402 is applied to the inverted (reference 138) input of the logic-AND gate 140.

Figure 11:
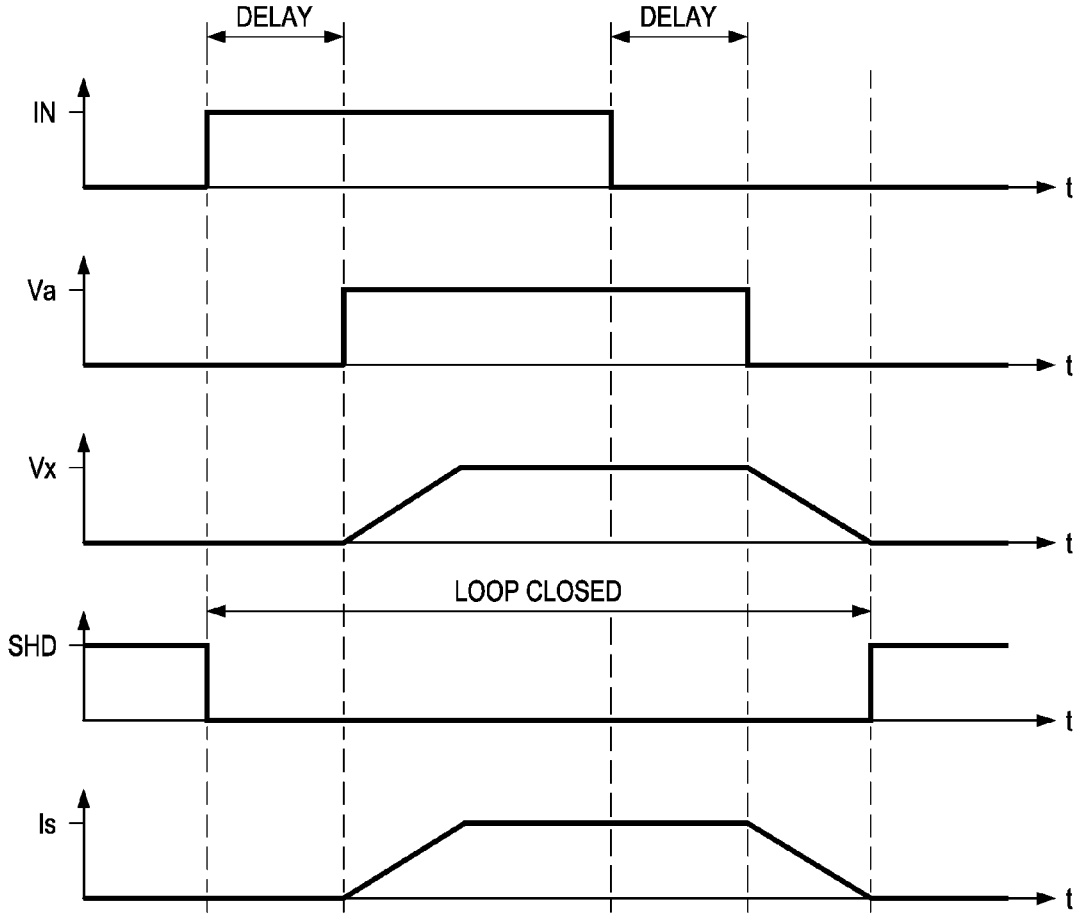
FIG. 11 illustrates operating waveforms for the circuit of FIG. 10.

The operation of the loop timing control circuit 26 of FIG. 10 is shown in FIG. 11. To ensure that the error amplifier 110 is stable before the reference voltage signal Vx begins to rise, the loop timing control circuit 26 of FIG. 10 adjusts the loop timing in comparison to the operation of FIGS. 2 and 3. The input data signal (IN) is delayed (reference 410) before application to the voltage level conditioning circuit 14 for the generation of the reference voltage signal Vx. The transition to logic high ("1") for the input data signal (IN) is applied through the logic-OR gate 402 to cause the feedback loop to close through actuation of switch S2. Once the feedback loop is closed, the error amplifier 110 is given a time delay (reference 410) to settle before the reference voltage signal Vx, delayed through delay 400 and signal Va, begins to rise. The current spike perturbation in the output current Is will then be avoided.

Figure 12:
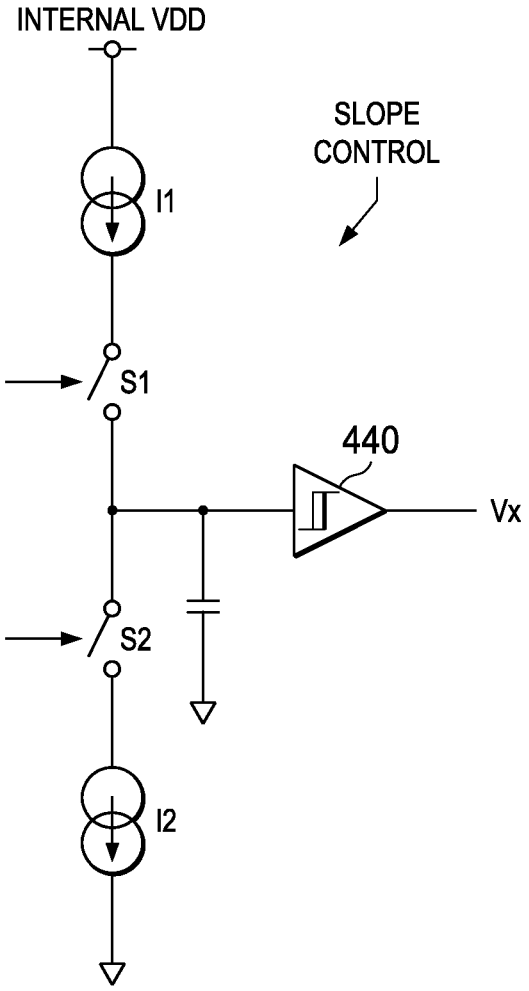
FIG. 12 is a circuit diagram of a circuit configuration for the voltage level conditioning circuit of FIG. 4.

FIG. 12 shows an alternate circuit configuration for the voltage level conditioning circuit 14 which implements a delay in generation of the reference voltage signal Vx. A hysteresis circuit 440 is coupled to the slope capacitor Cs so as to introduce a delay in the rise of the reference voltage signal Vx. It will be understood that the circuits of FIG. 6A-6C may also be modified to include the hysteresis circuit 440.

The foregoing description has provided by way of exemplary and non-limiting examples a full and informative description of one or more exemplary embodiments of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. A circuit, comprising:

a controlled current source configured to generate an output current in response to a difference between a first input signal derived from a modulated digital input signal and a second input signal;

a current sensing circuit configured to sense the output current and generate a feedback signal;

a switching circuit configured to selectively apply one of a fixed reference signal and the feedback signal as the second input signal to the controlled current source;

wherein the switching circuit is configured to apply the feedback signal as the second input signal in response to a transition of the modulated digital input signal from a first logic state to a second logic state; and wherein the switching circuit is configured to apply the fixed reference signal as the second input signal in response to a transition of the modulated digital input signal from the second logic state to the first logic state.

2. The circuit of claim 1, wherein the switching circuit further comprises a comparator circuit configured to compare the feedback signal to a reference current and impose a delay in the application of the fixed reference signal following said transition of the modulated digital input signal from the second logic state to the first logic state until a result of the comparison indicates that the feedback signal meets the reference current.

3. The circuit of claim 1, further comprising a conditioning circuit configured to apply a slope to transitions of the modulated digital input signal between the first logic state and second logic state in generating said first input signal.

4. The circuit of claim 3, wherein the conditioning circuit comprises a capacitance that is configured to be charged and discharged in response to transitions of the modulated digital input signal between the first logic state and second logic state .

5. The circuit of claim 3, wherein the conditioning circuit comprises a delay circuit configured to delay said first input signal before application to said controlled current source.

6. The circuit of claim 1, wherein said switching circuit comprises:

a first switch coupled between a source of the fixed reference signal and an input of the controlled current source that is configured to receive the second input signal; and a second switch coupled between an output of the current sensing circuit configured to generate the feedback signal and said input of the controlled current source that is configured to receive the second input signal.

7. The circuit of claim 6, further comprising a logic circuit that receives the first input signal and the feedback signal and is configured to generate control signals for controlling actuation of the first switch in response to said transition of the modulated digital input signal from a first logic state to a second logic state and controlling actuation of the second switch in response to said transition of the modulated digital input signal from the second logic state to the first logic state.

8. The circuit of claim 7, wherein said logic circuit further comprises:

a comparator circuit configured to compare the feedback signal to a reference current; and logic configured to delay actuation of the second switch following said transition of the modulated digital input signal from the second logic state to the first logic state until said comparator circuit indicates that the feedback signal has met the reference current.

9. The circuit of claim 7, further comprising a delay circuit configured to delay said first input signal before application to said controlled current source, but wherein said logic circuit is responsive to said first input signal without delay.

10. The circuit of claim 1, further comprising a clamping circuit configured to clamp a maximum value of said feedback signal.

11. The circuit of claim 1, wherein said controlled current source comprises:

an error amplifier having a first input configured to receive said first input signal and a second input configured to receive said second input signal and generate a control signal; and a MOS transistor having a gate terminal coupled to receive said control signal and a source-drain path configured to generate said output current.

12. The circuit of claim 11, wherein said error amplifier comprises:

a differential amplifier coupled to receive said first and second input signals;

a differential drive circuit having an input coupled to an output of the differential amplifier and having an output; and a boosting circuit having an input coupled to receive said control signal and having an output coupled to the input of the differential drive circuit.

13. The circuit of claim 12, wherein said boosting circuit comprises:

a boost amplifier having first and second inputs and an output coupled to the input of the differential drive circuit;

an additional switching circuit configured to selectively apply an additional fixed reference signal or the control signal as the first input of the boost amplifier; and a reference generator circuit configured to apply a reference to said second input of the boost amplifier.

14. The circuit of claim 13:

wherein the additional switching circuit is configured to apply the control signal to the first input of the boost amplifier in response to said transition of the modulated digital input signal from the first logic state to the second logic state; and wherein the additional switching circuit is configured to apply the additional fixed reference signal to the first input of the boost amplifier in response to said transition of the modulated digital input signal from the second logic state to the first logic state.

15. A method, comprising:

generating an output current in response to a difference between a first input signal derived from a modulated digital input signal and a second input signal;

sensing the output current to generate a feedback signal; and selectively applying a fixed reference signal or the feedback signal as the second input signal, wherein selectively applying comprises:

applying the feedback signal in response to a transition of the modulated digital input signal from a first logic state to a second logic state; and applying the fixed reference signal in response to a transition of the modulated digital input signal from the second logic state to the first logic state.

16. The method of claim 15, further comprising:

comparing the feedback signal to a reference current; and delaying application of the fixed reference signal following said transition of the modulated digital input signal from the second logic state to the first logic state until the feedback signal meets the reference current.

17. The method of claim 15, further comprising conditioning said first input signal to include slopes at transitions of the modulated digital input signal between the first logic state and second logic state.

18. The method of claim 17, further comprising:

delaying said first input signal before a comparison to said second input signal; and applying the feedback signal in response to transition of the first input signal without application of said delay.

19. The method of claim 15, further comprising clamping a maximum value of said feedback signal.

20. A circuit, comprising:

an input configured to receive a modulated digital input signal;

a conditioning circuit having an input configured to receive the modulated digital input signal and an output configured to generate a first input signal having sloped logic state transitions;

an error amplifier circuit having a first input configured to receive the first input signal and a second input configured to receive a second input signal;

a MOS transistor having a gate coupled to an output of the error amplifier and a source-drain path configured to generate an output signal that is current modulated in accordance with the modulated digital input signal;

a sensing circuit configured to sense said output signal and generated a feedback signal;

a switching circuit configured to selectively apply one of a fixed reference signal and the feedback signal as the second input signal to the error amplifier; and a control circuit configured to control operation of the switching circuit so as to:

apply the feedback signal as the second input signal in response to a transition of the modulated digital input signal from a first logic state to a second logic state; and apply the fixed reference signal as the second input signal in response to a transition of the modulated digital input signal from the second logic state to the first logic state.

21. The circuit of claim 20, wherein the control circuit comprises a comparator circuit configured to compare the feedback signal to a reference current, said control circuit further configured to control operation of the switching circuit so as to delay in the application of the fixed reference signal following said transition of the modulated digital input signal from the second logic state to the first logic state until the comparator circuit indicates that the feedback signal meets the reference current.

22. The circuit of claim 20, further comprising a delay circuit configured to delay receipt of the modulated digital input signal by the conditioning circuit beyond receipt of the modulated digital input signal by the control circuit.

23. The circuit of claim 20, further comprising a delay circuit configured to delay application of the first input signal to said error amplifier.

24. The circuit of claim 20, wherein said error amplifier circuit comprises:

an input differential amplifier having an output;

a differential drive circuit having an input coupled to an output of the differential amplifier and having an output; and a boosting circuit having an input coupled to receive said control signal and having an output coupled to the input of the differential drive circuit.

25. The circuit of claim 24, wherein said boosting circuit comprises:

a boost amplifier having first and second inputs and an output coupled to the input of the differential drive circuit;

an additional switching circuit configured to selectively apply an additional fixed reference signal or the control signal as the first input of the boost amplifier; and a reference generator circuit configured to apply a reference to said second input of the boost amplifier.

26. The circuit of claim 25, wherein said control circuit is configured to control operation of the additional switching circuit so as to:

apply the control signal to the first input of the boost amplifier in response to said transition of the modulated digital input signal from the first logic state to the second logic state; and apply the additional fixed reference signal to the first input of the boost amplifier in response to said transition of the modulated digital input signal from the second logic state to the first logic state.

* * * * *